US006293292B1

(12) United States Patent
Watzke

(10) Patent No.: US 6,293,292 B1
(45) Date of Patent: Sep. 25, 2001

(54) SUN SHADE

(76) Inventor: Ben Watzke, 17670 Warwick Cir., Fountain Valley, CA (US) 92708

( * ) Notice: Subject to any disclaimer, the term of this patent is extended or adjusted under 35 U.S.C. 154(b) by 0 days.

(21) Appl. No.: 09/545,896

(22) Filed: Apr. 8, 2000

(51) Int. Cl.[7] ..... E04H 15/34; A47C 7/62

(52) U.S. Cl. ..... 135/123; 135/87; 135/96; 135/151; 248/231.41; 248/284.1; 297/184.1

(58) Field of Search ..... 135/95, 96, 88.03, 135/88.04, 123, 151, 155, 87; 297/184.1, 184.11, 184.15; 248/230.5, 230.3, 230.1, 231.41, 231.64, 284.1, 227.4, 479

(56) References Cited

U.S. PATENT DOCUMENTS

D. 261,843 * 11/1981 Wall .
494,333 * 3/1893 Hill .
551,050 * 12/1895 Schmid .
587,569 * 8/1897 Ehmann .
603,916 * 5/1898 Metzger .
614,364 * 11/1898 Burnham .
985,852 * 3/1911 Spivey .
2,598,588 * 5/1952 Mullen .
2,828,758 * 4/1958 Moro .
3,011,240 * 12/1961 Legate .
3,050,280 * 8/1962 Regan .
4,068,673 * 1/1978 Bernardi .
4,082,102 4/1978 Heuer ..... 135/5
4,293,162 * 10/1981 Pap et al. .
4,836,232 * 6/1989 De Rosa et al. .
4,858,990 * 8/1989 Combs-Rose et al. .
4,865,380 * 9/1989 Heitzman-Powell et al. .
5,033,528 * 7/1991 Volcani .
5,301,999 * 4/1994 Thompson et al. .
5,397,268 3/1995 Chang ..... 454/338
5,441,067 8/1995 James ..... 135/96
5,553,914 * 9/1996 Holladay .
5,638,849 6/1997 Scott ..... 135/96

* cited by examiner

*Primary Examiner*—Robert Canfield
(74) *Attorney, Agent, or Firm*—Goldstein Law Offices PC

(57) ABSTRACT

A sun shade, for use by an individual in blocking the sun from the face and head of that individual, in conjunction with an article of outdoor furniture having a furniture member. The sun shade comprises a blocking panel, a clamp for attaching to the furniture member, and a extendible arm for positioning the blocking panel between. the face of the individual and the sun. The blocking panel includes a pair of blocking panel frame members which are selectively bowed outward to stretch a stretchable fabric panel therebetween to define the blocking panel, and selectively straighten to allow for storage of the sun shade while the stretchable fabric folds therebetween.

5 Claims, 4 Drawing Sheets

SUN SHADE

BACKGROUND OF THE INVENTION

The invention relates to a sun shade. More particularly, the invention relates to a device which provides a small area of shade which is easily positionable to block the sun's rays from reaching the head of the user.

People enjoy sitting or lying in the sun when at the beach, at the pool, or even in their backyards. Sunbathing can be relaxing and can enhance one's appearance. However, whether lying on the beach, or sitting and reading, many people find it undesirable to have the sun shine directly on their face. The hot sun can be irritating to sensitive facial skin, and over-exposure can lead to various skin conditions. In addition, over-exposure of the suns rays can lead to premature facial aging.

People have sought to selectively block the sun's rays using umbrellas which either attach to their chair, or stick in the ground. However, it is difficult to use an umbrella to selectively block the sun from portions of the body such as the face, while allowing the sun's rays to reach the remainder of the body.

U.S. Pat. No. 4,082,102 to Heuer, U.S. Pat. No. 5,441,067 to James et al., U.S. Pat. No. 5,397,268 to Chang, and U.S. Pat. No. 5,638,849 to Scott all disclose devices which attach onto a chair, and provide an area of sun protection. However, each of these devices either fails to provide sufficient adjustability to block the sun regardless of its position relative to the chair, or fail to fold for compact storage.

While these units may be suitable for the particular purpose employed, or for general use, they would not be as suitable for the purposes of the present invention as disclosed hereafter.

SUMMARY OF THE INVENTION

It is an object of the invention to produce a sun shade which conveniently provides protection for an individual from the sun in precisely those areas desired by the individual. Accordingly, the sun shade has a sun blocking panel which is user positionable to selectively block the sun from a portion of the user's body.

It is another object of the invention that the sun shade folds for compact storage. Accordingly, the extension arm is fully foldable and the sun blocking panel itself folds for truly compact storage.

It is still another object of the invention to provide a sunshade which is readily attachable onto numerous already existing chairs and other outdoor furniture. Accordingly, the clamping device is adjustable so it is capable onto attaching onto furniture of all sizes and configurations.

The invention is a sun shade, for use by an individual in blocking the sun from the face and head of that individual, in conjunction with an article of outdoor furniture having a furniture member. The sun shade comprises a blocking panel, a clamp for attaching to the furniture member, and a extendible arm for positioning the blocking panel between the face of the individual and the sun. The blocking panel includes a pair of blocking panel frame members which are selectively bowed outward to stretch a stretchable fabric panel therebetween to define the blocking panel, and selectively straighten to allow for storage of the sun shade while the stretchable fabric folds therebetween.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

Figure 1:
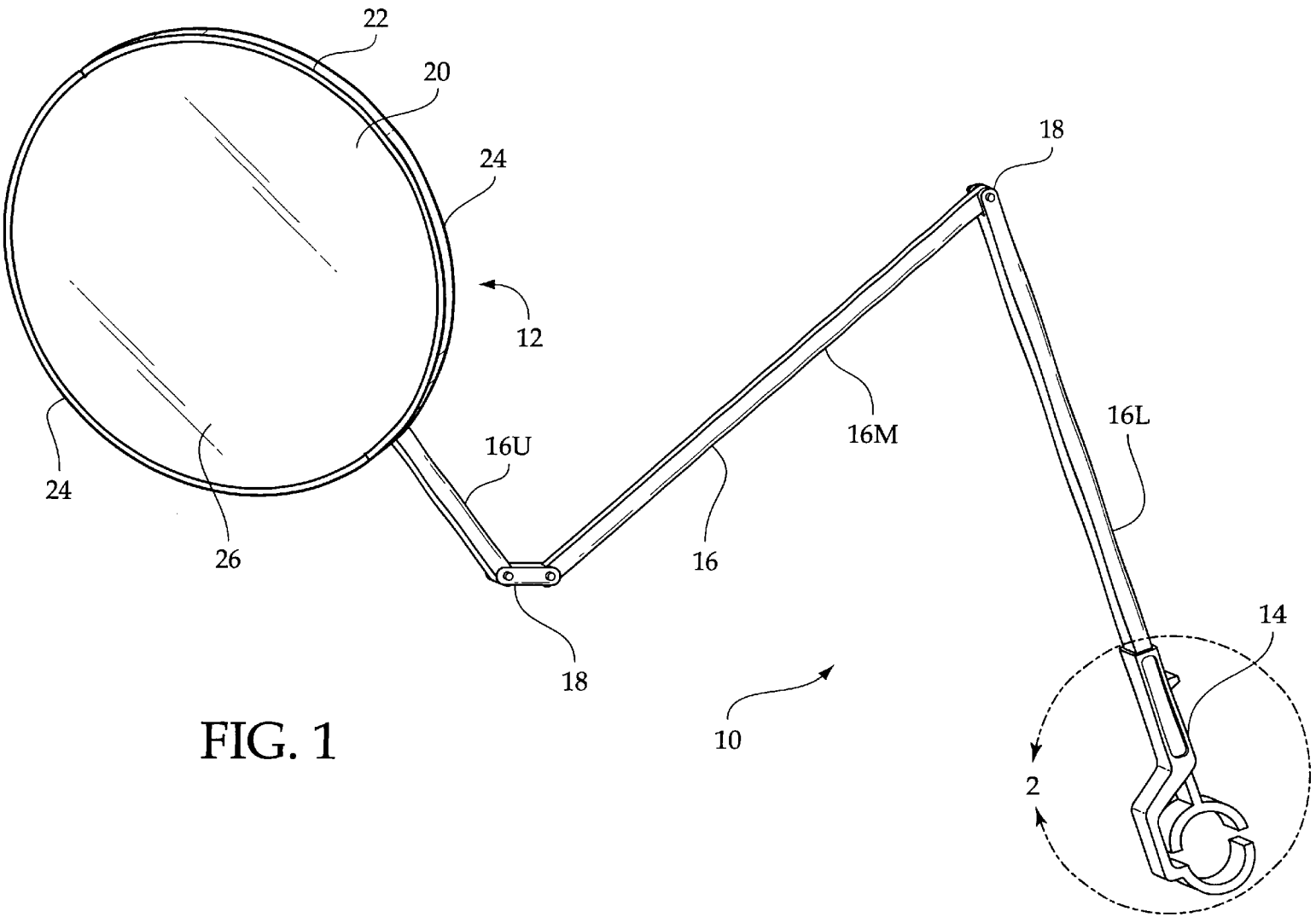
FIG. 1 is a diagrammatic perspective view, illustrating the sun shade in an expanded position.

FIG. 1 illustrates a sun shade 10 comprising a sun blocking panel assembly 12, a clamp device 14, and an extendible arm assembly 16 which connects the clamp device 14 and the blocking panel assembly 12. The extendible arm assembly 16 includes an upper arm 16U, a lower arm 16L, and a middle arm 16M. The upper arm 16U and middle arm 16M are connected by a pivot hinge 18, which may be a compound hinge. The lower arm 16L and middle arm 16M are also connected by a pivot hinge 18. The lower arm 16L is connected to the clamp device 14, and the upper arm 16U is connected to the blocking panel assembly 12.

The blocking panel assembly 12 includes a blocking panel 20, which is defined by a blocking panel frame 22, which in turn comprises a pair of blocking panel frame members 24 and a stretchable netting 26 which is stretched between the blocking panel frame members 24 to define the blocking panel 20, which is an effectively opaque object which prevents the sun's rays from passing therethrough.

Figure 2:
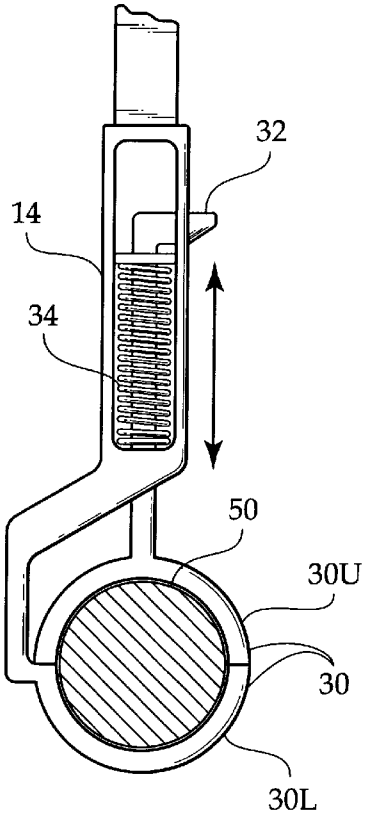
FIG. 2 is a side elevational view with parts broken away, illustrating the clamp device installed onto a furniture member.

FIG. 2 details the clamp device 14, which comprises a pair of crescents 30, an actuating lever 32, and a clamp spring 34. The crescents 30 include a lower crescent 30L and an upper crescent 30U, which are tensioned together by the clamp spring. In ordinary use, the sun shade 10 is attached onto a piece of furniture, having a furniture member 50. Accordingly, to attach the sun shade 10 onto the piece of furniture, the lower crescent 30L and upper crescent 30U encircle and tighten upon the furniture member 50. As illustrated in FIG. 2, in order to attach the sun shade thereon, the upper crescent 30U is raised by pulling the actuating lever 32 upward, stretching the clamp spring 34. The furniture member 50 can then be inserted between the upper crescent 30U and lower crescent 30L. When the actuating lever 32 is released, the clamp spring 34 will return the upper crescent 30U to its position tight against the lower crescent 30L, thus tightly holding the furniture member 50 therebetween.

Typically, the crescents will have a non-slip material such as rubber on portions thereof which contact the furniture member 50, so as to prevent scratching, marring, or otherwise damaging the furniture member. In addition, the clamp device 14 can be configured so that the the actuating lever 32 is pressed downward to increase the distance between the crescents 30. In such a configuration, the actuating lever 32 would then return upward when released to hold the crescents 30 tightly around the furniture member 50.

Figure 4:
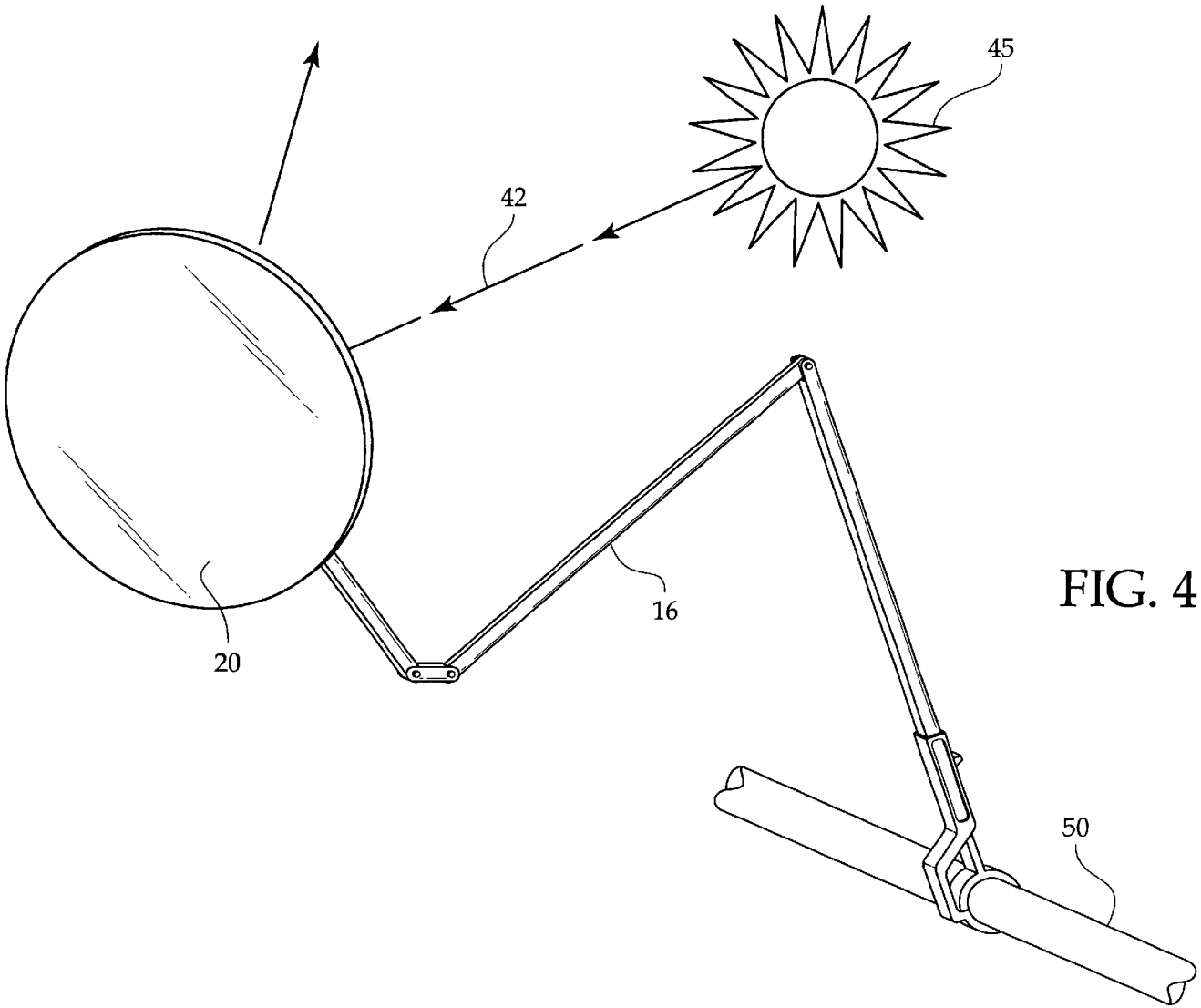
FIG. 4 is a diagrammatic perspective view, illustrating the sun shade attached onto a furniture member.

Referring to FIG. 4, once the sun shade 10 is properly attached onto the furniture member 50, the extendible arm assembly 16 may be adjusted to position the blocking panel 20 in an optimum position, wherein it either blocks or reflects rays 42 from the sun 45.

Figure 3:
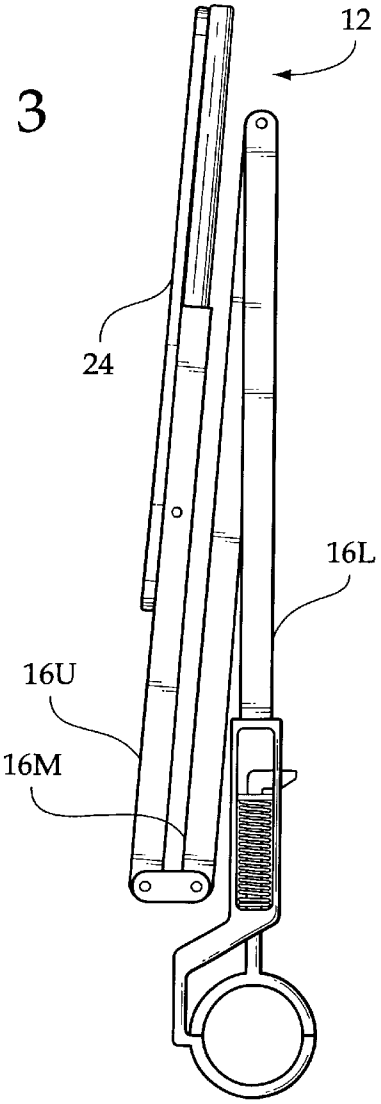
FIG. 3 is a side elevational view of the sun shade, in a folded position, wherein it is ready to be transported or for compact storage.

FIG. 3 illustrates the sun shade 10 in its folded position, wherein the upper arm 16U, lower arm 16L, and middle arm 16M are extending substantially parallel, and accordingly are all close together. In addition, the blocking panel assembly 12 is in the folded position, wherein the blocking panel frame members 24 are extending in their substantially straight position, wherein the blocking panel itself is minimized in a manner that will be clear following the discussion of FIG. 5 and 6, immediately hereinafter.

Figure 5:
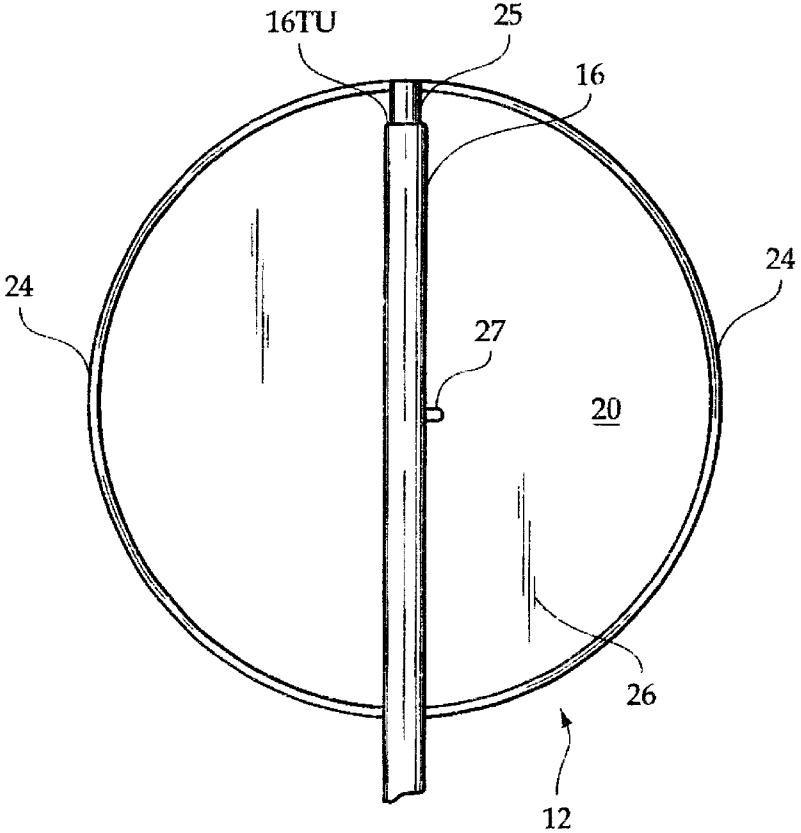
FIG. 5 details just the sun blocking panel assembly, when the sun shade is in the expanded position.

FIG. 5 illustrates the blocking panel assembly 12. The blocking panel assembly 12 includes a telescoping member 25 which preferably extends from the upper arm top 16TU, and selectively telescopes upward therefrom, or retracts into the upper arm 16U. The blocking panel assembly 12 is shown in its expanded position, wherein the telescoping member 25 has been pushed downward into the upper arm 16U. Accordingly, the blocking panel frame members 24 are bowed outward, causing the stretchable netting 26 to form the blocking panel 20 in the shape of a circle.

The blocking panel frame members 24 are preferably made of wire or a flat band of metal, wherein one end of each blocking panel frame member 24 is attached to the upper arm 16U, and an opposite end of each blocking panel frame member 24 is attached to the telescoping member 25. A lock 27 is used to maintain the blocking panel 20 by keeping the blocking panel frame members 24 bowed outward. Because the blocking panel frame members 24 are made of wire, or a flattened band of metal, they have a tendency to flex back when bowed. Accordingly, the lock prevents the blocking panel frame members 24 from becoming un-bowed, and thus maintains the shape of the blocking panel 20.

Figure 6:
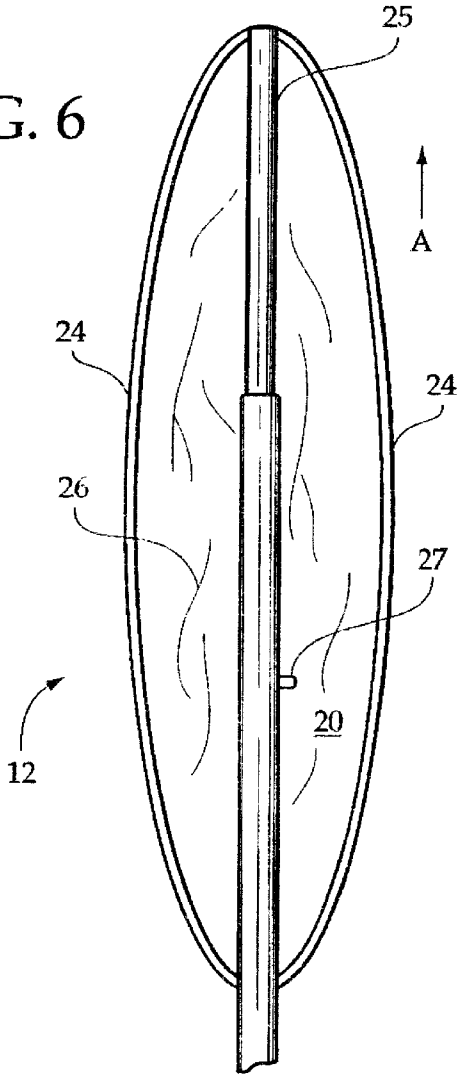
FIG. 6 details just the sun blocking panel assembly, when the sun shade is being placed in the folded position for storage.

Referring to FIG. 6, to put the sun shade into its storage position, the blocking panel assembly 12 is collapsed, in turn collapsing the blocking panel 20. As illustrated in FIG. 6, the lock 27 is released, causing the telescoping member 25 to move upward in the direction of arrow A, under the natural spring force of the blocking panel frame members 24. Accordingly, the blocking panel frame members 24 spring toward their straightened position, and the stretchable material 26 folds therebetween, thus minimizing the overall size of the sun shade 10, and thus allowing the sun shade to be stored more compactly than previously proposed sun shades in the prior art.

In conclusion, herein is presented a sun shade which has attaches onto existing outdoor furniture, and has a blocking panel which allows the sun to be effectively blocked from the head and face of the user, and collapsed and stores compactly when not in use.

What is claimed is:

1. A sun shade, for use in conjunction with an article of outdoor furniture having a furniture member, by an individual having a head and a face, to block the sun from said head and face, comprising, a clamp device, having a pair of crescents including an upper crescent and a lower crescent, having an actuating lever, the actuating lever operative to separate the upper crescent from the lower crescent to allow the furniture member to be inserted therebetween, and having a clamp spring, the clamp spring causing the upper crescent to return against the lower crescent to hold the furniture member tightly therebetween;

a blocking panel assembly, the blocking panel assembly having a blocking panel, the blocking panel having an extended position and a storage position, the blocking panel defined by a blocking panel frame having a pair of blocking panel frame members, the blocking panel frame members formed of a spring-like metal selected from wire and flat metal bands, the blocking panel further comprising stretchable material extending between the blocking panel frame members, when the blocking panel is in the extended position the blocking panel frame members are bowed outward, stretching the stretchable material and defining a blocking panel capable of blocking the sun from the head and face of the individual, when the blocking panel is in the storage position, the blocking panel frame members extend substantially straightened, such that the stretchable material folds therebetween; and an extendible arm, having an upper arm, a middle arm, and a lower arm, the upper arm and middle arm are connected at pivot hinges, the lower arm and middle arm are connected at pivot hinges, the lower arm connected to the clamp device, the upper arm is connected to the blocking panel assembly, the extendible arm is positionable so as to position the blocking panel so as to block the sun from the face and head of the individual, and is foldable wherein the lower arm, middle arm, and upper arm are substantially parallel to each other and are in close proximity to each other to allow for compact storage of the sun shade.

2. A sun shade, for use in conjunction with an article of outdoor furniture having a furniture member, by an individual having a head and a face to block the sun from said head and face, comprising, a clamp device, for attaching to the furniture member;

a blocking panel assembly, the blocking panel assembly having a blocking panel, the blocking panel having an extended position and a storage position, when the blocking panel is in the extended position the blocking panel is capable of blocking the sun from the head and face of the individual, said blocking panel being defined by a blocking panel frame having a pair of blocking panel frame members, the blocking panel frame members formed of a spring-like metal selected from wire and flat metal bands, the blocking panel further comprising stretchable material extending between the blocking panel frame members, when the blocking panel is in the extended position the blocking panel frame members are bowed outward, stretching the stretchable material and defining a blocking panel capable of blocking the sun from the head and face of the individual, when the blocking panel is in the storage position, the blocking panel frame members extend substantially straightened, such that the stretchable material folds therebetween; and an extendible arm, the clamp attached to the extendible arm, the extendible arm is positionable so as to position the blocking panel so as to block the sun from the face and head of the individual, and is foldable to allow for compact storage of the sun shade, said arm comprising an upper arm having an upper arm top, the blocking panel connected to the upper arm top, wherein the blocking panel assembly further comprises a telescoping member capable of extending upward from the upper arm top and retracting thereinto, each of the blocking panel frame members are attached on one end to the upper arm and on an opposite end to the telescoping member, when the telescoping member telescopes upward from the upper arm the blocking panel frame members are straightened, folding the stretchable material therebetween, when the telescoping member retracts downward into the upper arm the blocking panel frame members bow outward, stretching the stretchable material and defining the blocking panel in its extended position.

3. The sun shade as recited in claim 2, the clamp device further having a pair of crescents including an upper crescent and a lower crescent, having an actuating lever, the actuating lever operative to separate the upper crescent from the lower crescent to allow the furniture member to be inserted therebetween, and having a clamp spring, the clamp spring causing the upper crescent to return against the lower crescent to hold the furniture member tightly therebetween.

4. The sun shade as recited in claim 3, wherein the extendible arm further has a middle arm, and a lower arm, the upper arm and middle arm are connected at pivot hinges, the lower arm and middle arm are connected at pivot hinges, the upper arm is connected to the blocking panel assembly, the extendible arm is positionable so as to position the blocking panel so as to block the sun from the face and head of the individual, and is foldable wherein the lower arm, middle arm, and upper arm are substantially parallel to each other and are in close proximity to each other to allow for compact storage of the sun shade.

5. The sun shade as recited in claim 4, wherein the blocking assembly further comprises a lock, such that the telescoping member may be locked in the retracted position to maintain the blocking panel in its extended position with the blocking panel frame members bowed outward, and the lock is capable of releasing to allow the blocking frame members to spring inward, pushing the telescoping member upward to bring the sun shade into the storage position.

* * * * *